US007915797B2

(12) United States Patent
Liu et al.

(10) Patent No.: US 7,915,797 B2
(45) Date of Patent: Mar. 29, 2011

(54) THERMIONIC ELECTRON SOURCE

(75) Inventors: Peng Liu, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 242 days.

(21) Appl. No.: 12/288,865

(22) Filed: Oct. 23, 2008

(65) Prior Publication Data

US 2009/0167138 A1 Jul. 2, 2009

(30) Foreign Application Priority Data

Dec. 29, 2007 (CN) ..... 2007 1 0125659

(51) Int. Cl.
*H01J 9/02* (2006.01)

(52) U.S. Cl. ..... 313/310; 313/346 R

(58) Field of Classification Search ..... 313/309, 313/310, 336, 346, 346 R
See application file for complete search history.

(56) References Cited

U.S. PATENT DOCUMENTS

| | | | |
|---|---|---|---|
| 5,905,335 | A | 5/1999 | Fushimi et al. |
| 2003/0160570 | A1 | 8/2003 | Sasaki et al. |
| 2009/0167136 | A1 | 7/2009 | Liu et al. |

FOREIGN PATENT DOCUMENTS

| | | | |
|---|---|---|---|
| CN | 1440044 | A | 9/2003 |
| CN | 1773664 | A | 5/2006 |
| CN | 101471211 | A | 7/2009 |
| EP | 125859 | * | 11/1984 |

OTHER PUBLICATIONS

Cox et al., Themionix emission from defective carbon nanotubes, Applied Physics Letter, Sep. 13, 2004, 2065-2067, vol. 85, No. 11.

* cited by examiner

*Primary Examiner* — Vip Patel
(74) *Attorney, Agent, or Firm* — D. Austin Bonderer

(57) ABSTRACT

A thermionic electron source includes a substrate, two electrodes, and a thermionic emitter. The thermionic emitter is electrically connected to the two electrodes. The substrate has a recess formed on a surface thereof, and the thermionic emitter is located on the surface of the substrate corresponding to the recess.

18 Claims, 5 Drawing Sheets

THERMIONIC ELECTRON SOURCE

RELATED APPLICATIONS

This application claims all benefits accruing under 35 U.S.C. §119 from China Patent Application No. 200710125659.X, filed on Dec. 29, 2007 in the China Intellectual Property Office, the contents of which are hereby incorporated by reference. This application is related to commonly-assigned U.S. applications entitled, "METHOD FOR MAKING THERMIONIC ELECTRON SOURCE", Ser. No. 12/286,241, filed on Sep. 29, 2008; "THERMIONIC EMISSION DEVICE", Ser. No. 12/288,996, filed on Oct. 23, 2008; "THERMIONIC EMISSION DEVICE", Ser. No. 12/288,863, filed on Oct. 23, 2008; "THERMIONIC ELECTRON EMISSION DEVICE AND METHOD FOR MAKING THE SAME", Ser. No. 12/288,864, filed on Oct. 23, 2008; and "THERMIONIC ELECTRON SOURCE", Ser. No. 12/288,862, filed on Oct. 23, 2008.

BACKGROUND

1. Field of the Invention

The present invention relates to a thermionic electron source adopting carbon nanotubes.

2. Discussion of Related Art

Carbon nanotubes (CNT) are a carbonaceous material and have received much interest since the early 1990s. Carbon nanotubes have interesting and potentially useful electrical and mechanical properties. Due to these and other properties, CNTs have become a significant contributor to the research and development of electron emitting devices, sensors, and transistors, among other devices.

Generally, an electron-emitting device has an electron source using a thermal or cold electron source. The thermal electron source is used by heating an emitter for increasing the kinetic energy of the electrons in the emitter. When the kinetic energy of the electrons therein is large enough, the electrons will emit or escape from the emitters. These electrons emitted from the emitters are thermions. The emitters emitting the thermions are known as thermionic emitters.

Conventionally, the thermionic electron source includes a thermionic emitter, and two electrodes. The two electrodes are located on a substrate. The thermionic emitter is located between two electrodes and electrically connected thereto. The thermionic emitter is generally made of a metal, a boride or an alkaline earth metal carbonate. The thermionic emitter can be divided into two types, a direct-heating type and an indirect-heating type. The thermionic emitter of the direct-heating type uses a metal ribbon or a metal thread as the thermionic emitter. The metal ribbon or metal thread is fixed between the two electrodes by welding. During use, a voltage is applied between the two electrodes to heat the metal ribbon or metal thread. Kinetic energy of the electrons in the metal ribbon or metal thread is increased. When the kinetic energy of the electrons therein is large enough, thermions will emit or escape from the emitters. The thermionic emitter of the indirect-heating type uses a boride or an alkaline earth metal carbonate such as the material of the thermionic emitter. The boride or alkaline earth metal carbonate is dispersed in conductive slurry, wherein the conductive slurry is directly coated or sprayed on a heater. The heater can be secured between the two electrodes as a thermionic emitter. During use, a voltage is applied between the two electrodes to heat the thermionic emitter. Kinetic energy of the electrons in the thermionic emitter is increased. When the kinetic energy of the electrons therein is large enough, thermions will emit or escape from the emitters. However, the size of the thermionic emitter using the metal, boride or alkaline earth metal carbonate is large, and thereby limits its application in microdevices. Furthermore, the coating formed by direct coating or from spraying the metal, boride or alkaline earth metal carbonate has a high resistivity, and thus, the thermionic electron source using the same has a greater power consumption and is therefore not suitable for applications involving high current density and brightness.

What is needed, therefore, is a thermionic electron source having excellent thermal electron emitting properties and wearability, and can be used in flat panel displays with high current density and brightness, logic circuits, and other fields of thermal electron source.

SUMMARY

In one embodiment, a thermionic electron source includes a substrate, two electrodes, and a thermionic emitter. The thermionic emitter is electrically connected to the two electrodes. The substrate has a recess formed therein, the recess defining a recess bottom at the bottom thereof The recess extends inwardly from a surface of the substrate. The two electrodes are formed on the substrate at opposite sides of the recess. The thermionic emitter is electrically connected at opposite sides thereof to the two electrodes. The thermionic emitter defines a first portion and a second portion. The first portion of the thermionic emitter extends between the two electrodes and across the recess in the substrate. The first portion has a first portion surface. The first portion surface directly faces the recess bottom.

BRIEF DESCRIPTION OF THE DRAWINGS

Many aspects of the present thermionic electron source can be better understood with references to the following drawings. The components in the drawings are not necessarily drawn to scale, the emphasis instead being placed upon clearly illustrating the principles of the present thermionic electron source.

Figure 1:
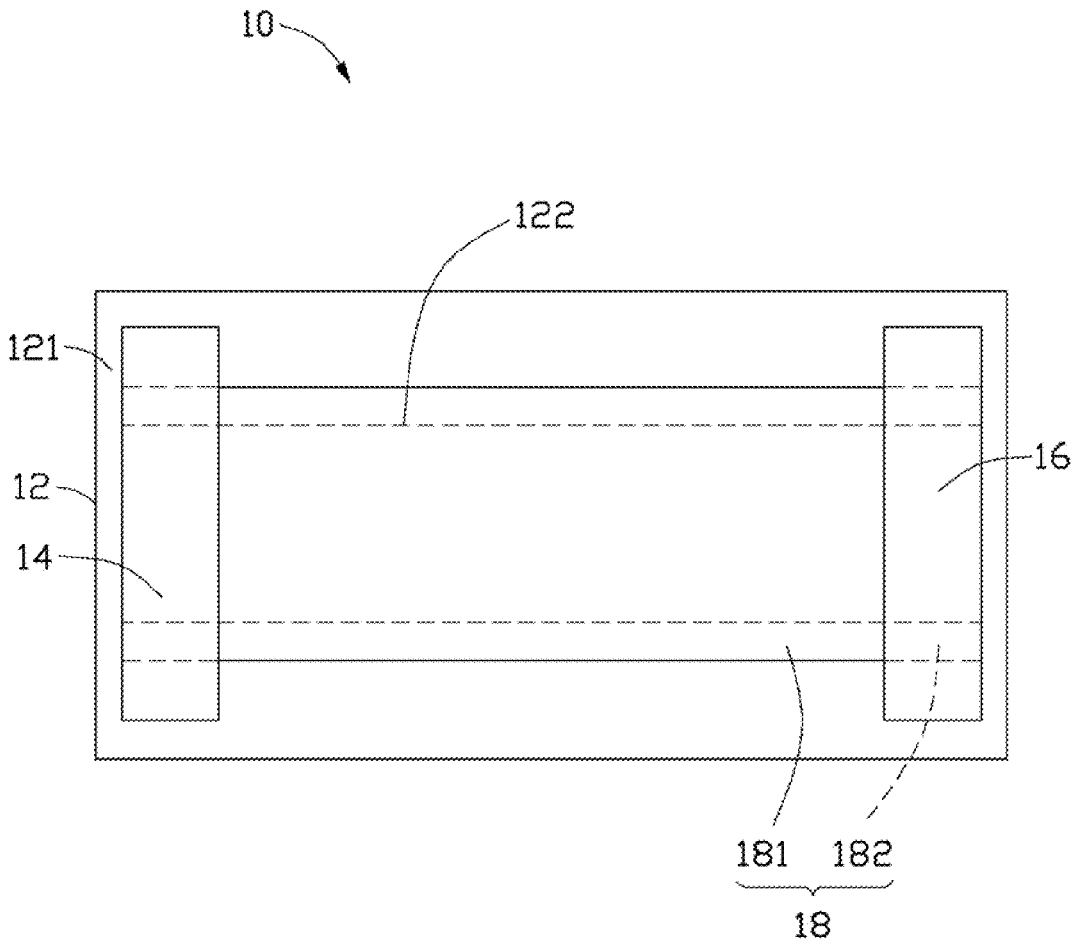
FIG. 1 is an exploded, isometric view of a thermionic electron source in accordance with the present embodiment.

Corresponding reference characters indicate corresponding parts throughout the views. The exemplifications set out herein illustrate at least one exemplary embodiment of the present thermionic electron source, in at least one form, and such exemplifications are not to be construed as limiting the scope of the invention in any manner.

DETAILED DESCRIPTION OF EXEMPLARY EMBODIMENTS

References will now be made to the drawings to describe, in detail, embodiments of the present thermionic electron source.

Figure 2:
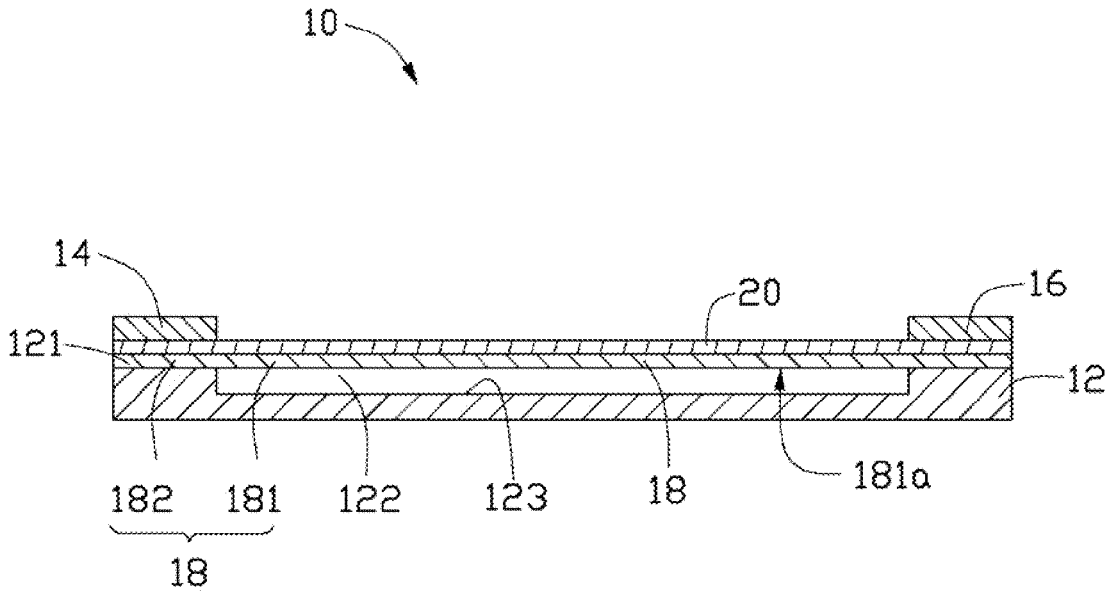
FIG. 2 is a transverse, cross-sectional view of the thermionic electron source of FIG. 1, in accordance with the present embodiment.

Referring to FIG. 1 and FIG. 2, a thermionic electron source 10 includes a substrate 12, a first electrode 14, a second electrode 16, and a thermionic emitter 18. The substrate 12 has a recess 122 formed in the substrate 12 to define a recess bottom 123. The recess 122 extends inwardly from a surface 121 of the substrate 12. The thermionic emitter 18 is located on the substrate 12 corresponding to the recess 122. The first electrode 14 and second electrode 16 are separately located on a surface of the thermionic emitter 18 away from the substrate 12 and electrically connected thereto. The electrode 14 and the electrode 16 are formed on the substrate 12 at opposite sides of the recess 122. The thermionic emitter 18 is suspended above the substrate 12 by the recess 122, thereby forming a space between the substrate 12 and the thermionic emitter 18. The recess 122 can be narrower than the thermionic emitter 18 (as shown) or wider. The thermionic emitter 18 defines a first portion 181 and a second portion 182. The first portion 181 of the thermionic emitter 18 extends between the electrode 14 and the electrode 16 and across the recess 122 in the substrate 12. The first portion 181 has a first portion surface 181*a*. The first portion surface 181*a* directly faces the recess bottom 123. The second portion 182 of the thermionic emitter 18 is in contact with the substrate 12. No article is interposed between the second portion 182 of the thermionic emitter 18 and the substrate 12.

The thermionic electron source 10 can also include a low-work-function layer 20 located on a surface of the thermionic emitter 18. The low-work-function layer 20 is made of any material capable of inducing the emissions of electrons from the thermionic electron source 10 at a low temperature, such as thorium oxide or barium oxide. Electrons in the low-work-function layer 20 have a lower work function than that in the thermionic emitter 18, and can escape from the low-work-function layer 20 at a lower temperature. Thus, the low-work-function layer 20 can be used to induce emissions of electrons from the thermionic electron source 10 at a lower temperature.

The substrate 12 can be made of ceramics, glass, resins, or quartz, among other materials. A size and shape of the substrate 12 can be set as desired. In the present embodiment, the substrate 12 is a glass substrate. A depth of the recess 122 ranges from 5 micrometers to 1 millimeter. A size and shape of the recess 122 can be set as desired. In the present embodiment, the recess is rectangular-shaped, a length thereof ranges from 50 micrometers to 1 millimeter, a width thereof ranges from 50 micrometers to 1 millimeter, and a height thereof ranges from 10 micrometers to 50 micrometers.

Figure 3:
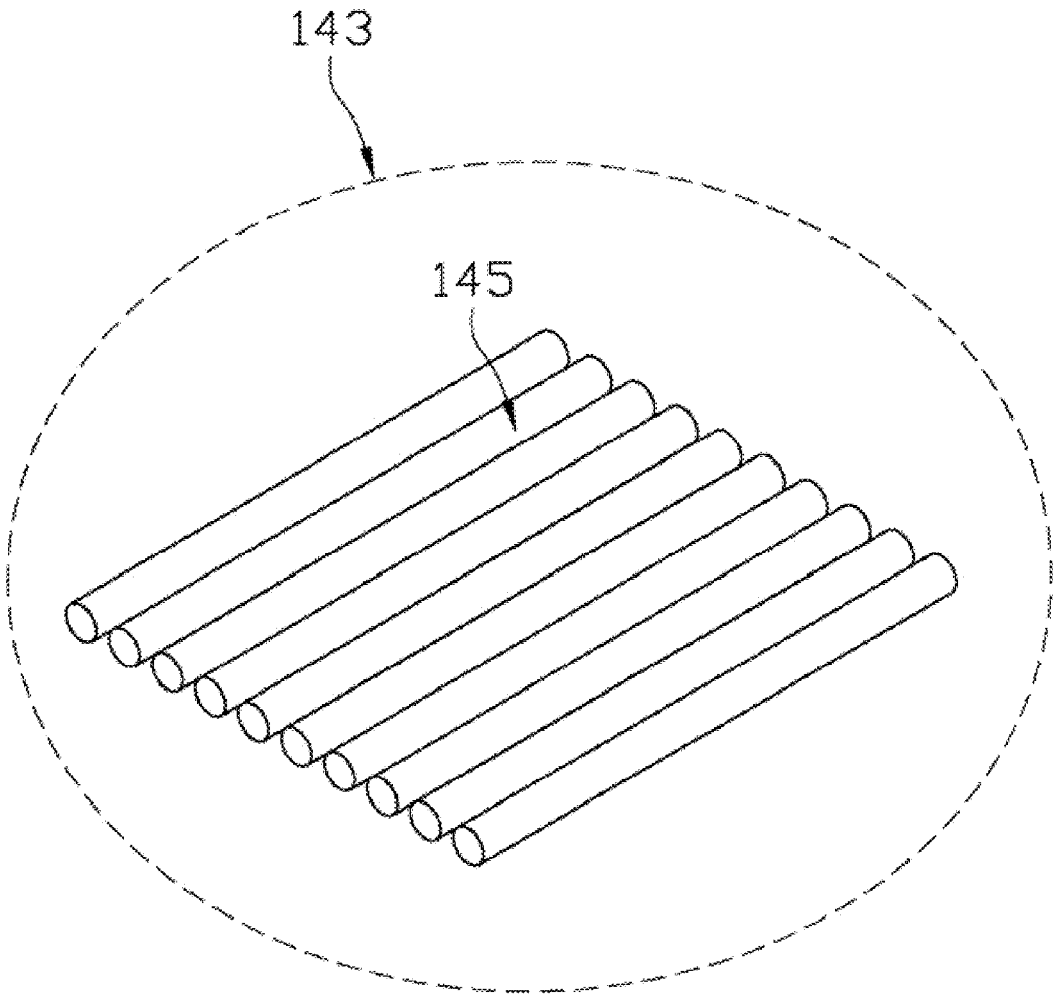
FIG. 3 is a structural schematic of a carbon nanotube segment.
Figure 4:
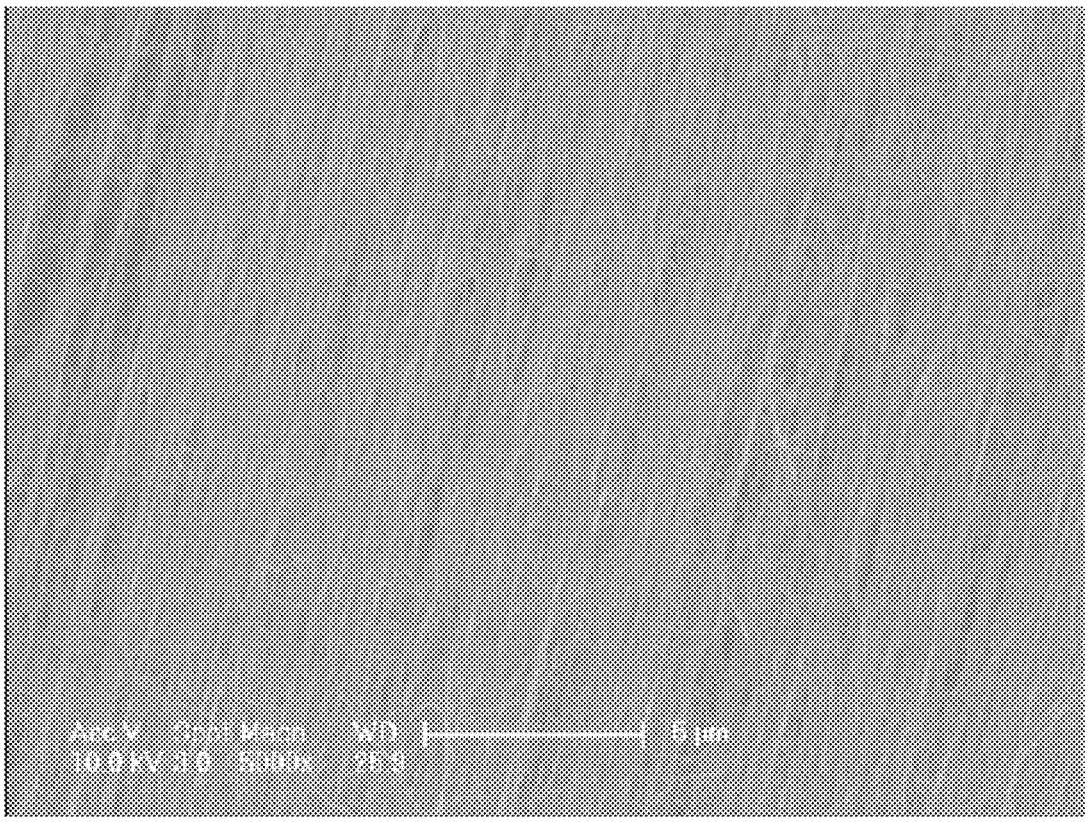
FIG. 4 shows a Scanning Electron Microscope (SEM) image of a carbon nanotube film.

The thermionic emitter 18 has a film structure or includes at least one wire. The thermionic emitter 18 is made of borides, oxides, metals or carbon nanotubes. A length of the thermionic emitter 18 approximately ranges from 50 micrometers to 1 millimeter. A width of the thermionic emitter 18 approximately ranges from 50 to 1 millimeter. In the present embodiment, the thermionic emitter 18 includes a carbon nanotube film structure. The carbon nanotube film structure includes at least one carbon nanotube film. Referring to FIGS. 3 and 4, each carbon nanotube film comprises a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. The carbon nanotubes 145 in the carbon nanotube film are also oriented along a preferred orientation. The thermionic emitter 18 includes a carbon nanotube film, and the carbon nanotubes 145 therein extend from the first electrode 14 and the second electrode 16. In other embodiments, the carbon nanotube film structure includes at least two carbon nanotube films combined by van der Waals attractive force therebetween. The films are situated such that a preferred orientation of the carbon nanotubes is set at an angle with respect to each other. The angle approximately ranges from 0° to 90°.

In the present embodiment, the carbon nanotube film is acquired by pulling from a carbon nanotube array grown on a 4-inch base. A width of the acquired carbon nanotube film approximately ranges from 0.01 to 10 centimeters. A thickness of the acquired carbon nanotube film approximately ranges from 10 nanometers to 100 micrometers. Furthermore, the carbon nanotube film can be cut into smaller predetermined sizes and shapes. The carbon nanotubes in the carbon nanotube film are selected from a group consisting of single-walled carbon nanotubes, double-walled carbon nanotubes, and multi-walled carbon nanotubes. Diameters of the single-walled carbon nanotubes approximately range from 0.5 to 10 nanometers. Diameters of the double-walled carbon nanotubes approximately range from 1 to 50 nanometers. Diameters of the multi-walled carbon nanotubes approximately range from 1.5 to 50 nanometers. Since the carbon nanotube film has a high surface-area-to-volume ratio, the carbon nanotube film may easily adhere to other objects. Thus, the carbon nanotube film can directly be fixed on the substrate 12 or other carbon nanotube films because of the adhesive properties of the nanotubes. The thermionic emitter 18 made by the carbon nanotubes can also be fixed on the substrate 12 via adhesive or conductive glue.

The first electrode 14 and second electrode 16 are separated in order to prevent a short circuit, wherein a voltage is applied therebetween. The first electrode 14 and second electrode 16 can be made of a material selected from a group consisting of conductive metals, graphite, carbon nanotubes, or any other conductive material. The conductive metals can be gold, silver, or copper. When the first electrode 14 and second electrode 16 are layer-shaped, which may be from of a metal coating, a metal foil, or a graphite layer, the first electrode 14 and second electrode 16 are adhesively fixed on the surface of the thermionic emitter 18. When the first electrode 14 and second electrode 16 contain carbon nanotubes that are inherently adhesive, the first electrode 14 and second electrode 16 can be directly adhered on the thermionic emitter 18 without the use of an adhesive. The method for fixing the first electrode 14 and second electrode 16 on the thermionic emitter 18 is not limited to the above-described methods. In the present embodiment, the first electrode 14 and second electrode 16 are a copper layer, and the first electrode 14 and second electrode 16 are adhesively fixed on the thermionic emitter 18 which is a carbon nanotube film.

Figure 5:
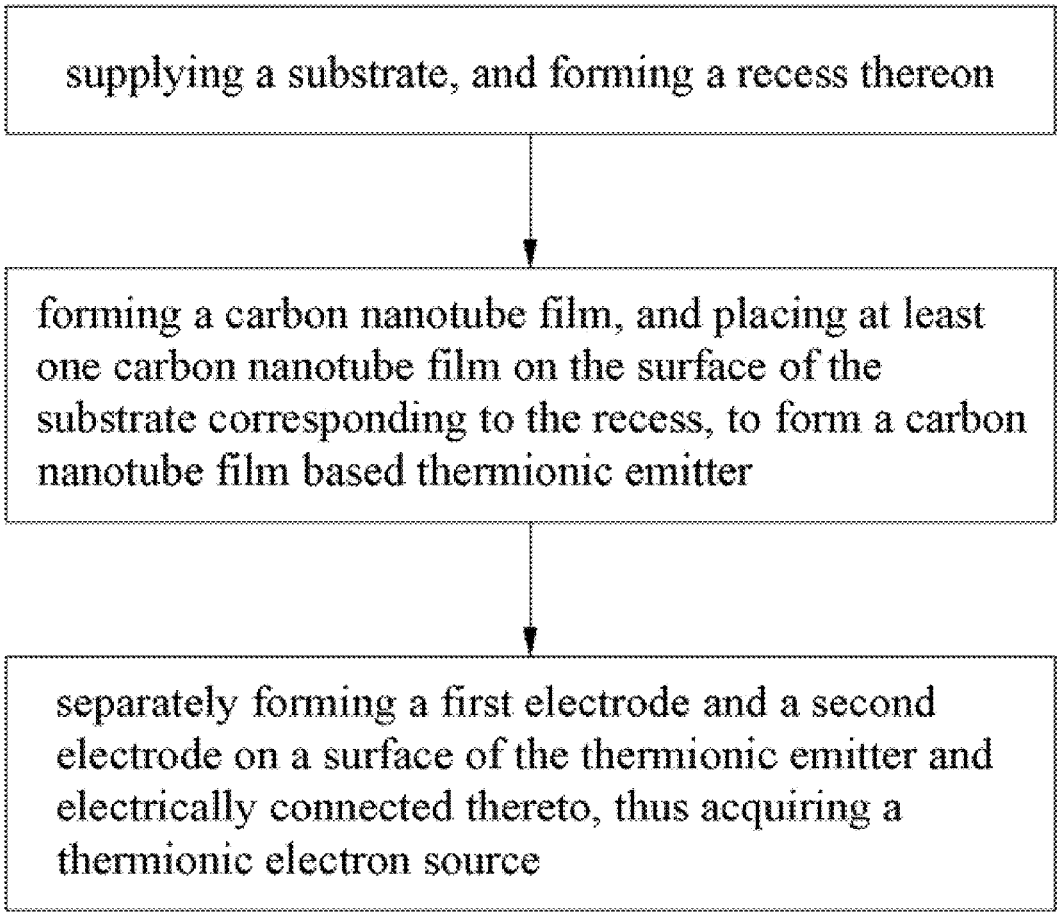
FIG. 5 is a flow chart of a method for making a thermionic electron source, in accordance with the present embodiment.

Referring to FIG. 5, a method for making the thermionic electron source 10 includes the following steps: (a) supplying a substrate, and forming a recess thereon; (b) forming a carbon nanotube film, and placing at least one carbon nanotube film on the surface of the substrate corresponding to the recess, to form a carbon nanotube film based thermionic emitter; and (c) separately forming a first electrode and a second electrode on a surface of the thermionic emitter and electrically connected thereto, thus acquiring a thermionic electron source.

In step (a), the substrate can be made of ceramics, glass, resins, or quartz, among other insulative materials. A size and shape of the substrate can be set as desired. In the present embodiment, the substrate is a glass substrate. A recess can be formed on the substrate by an etching method.

In step (b), the carbon nanotube film can be formed by the following steps: (b1) providing an array of carbon nanotubes, optionally a super-aligned array of carbon nanotubes; (b2) pulling out a carbon nanotube film from the array of carbon nanotubes by using a tool (e.g., adhesive tape, pliers, tweezers, or another tool allowing multiple carbon nanotubes to be gripped and pulled simultaneously).

In step (b1), a given super-aligned array of carbon nanotubes can be formed by the following substeps: firstly, providing a substantially flat and smooth substrate; secondly, forming a catalyst layer on the substrate; thirdly, annealing the substrate with the catalyst layer thereon in air at a temperature approximately ranging from 700° C. to 900° C. for about 30 to 90 minutes; fourthly, heating the substrate with the catalyst layer to a temperature approximately ranging from 500° C. to 740° C. in a furnace with a protective gas therein; and fifthly, supplying a carbon source gas to the furnace for about 5 to 30 minutes and growing the super-aligned array of carbon nanotubes on the substrate.

The substrate can be a P-type silicon wafer, an N-type silicon wafer, or a silicon wafer with a film of silicon dioxide thereon. In the present embodiment, a 4-inch P-type silicon wafer is used as the substrate. The catalyst can be made of iron (Fe), cobalt (Co), nickel (Ni), or any alloy thereof. The protective gas can be made up of at least one of nitrogen ($N_2$), ammonia ($NH_3$), and a noble gas. In step (a5), the carbon source gas can be a hydrocarbon gas, such as ethylene ($C_2H_4$), methane ($CH_4$), acetylene ($C_2H_2$), ethane ($C_2H_6$), or any combination thereof.

The super-aligned array of carbon nanotubes can be approximately 200 to 400 microns in height and include a plurality of carbon nanotubes parallel to each other and approximately perpendicular to the substrate. The carbon nanotubes in the array can be selected from a group consisting of single-walled carbon nanotubes, double-walled carbon nanotubes, or multi-wall carbon nanotubes. A diameter of the single-walled carbon nanotubes approximately ranges from 0.5 to 50 nanometers. A diameter of the double-walled carbon nanotubes approximately ranges from 1 to 10 nanometers. A diameter of the multi-walled carbon nanotubes approximately ranges from 1.5 to 10 nanometers.

The super-aligned array of carbon nanotubes formed under the above conditions is essentially free of impurities such as carbonaceous or residual catalyst particles. The carbon nanotubes in the super-aligned array are closely packed together by the van der Waals attractive force.

Step (b2) can be executed by selecting a plurality of carbon nanotube segments having a predetermined width from the array of carbon nanotubes, and pulling the carbon nanotube segments at an even/uniform speed to achieve a uniform carbon nanotube film.

The carbon nanotube segments having a predetermined width can be selected by using an adhesive tape such as the tool to contact with the super-aligned array. The pulling direction is substantially perpendicular to the growing direction of the super-aligned array of carbon nanotubes.

More specifically, during the pulling process, as the initial carbon nanotube segments are drawn out, other carbon nanotube segments are also drawn out end-to-end due to the van der Waals attractive force between ends of adjacent segments. This process of drawing ensures a continuous, uniform carbon nanotube film having a predetermined width can be formed. The carbon nanotubes in the carbon nanotube film are all substantially parallel to the pulling/drawing direction of the carbon nanotube film, and the carbon nanotube film produced in such manner can be selectively formed having a predetermined width. The carbon nanotube film formed by the pulling/drawing method has superior uniformity of thickness and conductivity over a disordered carbon nanotube film. Furthermore, the pulling/drawing method is simple, fast, and suitable for industrial applications.

The method for placing at least one carbon nanotube film on the surface of the substrate corresponding to the recess, to form a carbon nanotube film structure used as the thermionic emitter can be executed by three methods. The first method is executed by placing a carbon nanotube film on a surface of the substrate. The second method is executed by placing at least two carbon nanotube films stacked with each other on the substrate and situated such that a preferred orientation of the carbon nanotubes is set at an angle with respect to each other. The angle approximately ranges from 0° to 90°. The third method is executed by the following steps: (b3) supplying a supporting element; (b4) placing at least two carbon nanotube films stacked with each other and situated such that a preferred orientation of the carbon nanotubes being set at an angle with respect to each other to form a carbon nanotube film structure, the angle approximately ranging from 0° to 90°; (b5) cutting away excess portions of the carbon nanotube film structure; (b6) treating the carbon nanotube film structure via an organic solvent; (b7) removing the carbon nanotube film structure from the supporting element to form a free-standing carbon nanotube film structure; and (b8) placing the free-standing carbon nanotube film structure on the surface of the substrate. Since the carbon nanotube film has a high surface-area-to-volume ratio, the carbon nanotube structure formed by at least one carbon nanotube film may easily adhere to other objects. Thus, the carbon nanotube film can directly be fixed on the substrate due to the adhesive properties of the nanotubes. The carbon nanotube structure can also be secured on the substrate via adhesive or conductive glue.

The carbon nanotube film structure secured on the substrate can be treated with an organic solvent. The carbon nanotube film structure can be treated by applying the organic solvent to soak the entire surface of the carbon nanotube film structure or immersing the carbon nanotube film structure in a container with organic solvent filled. The organic solvent is volatilizable and can be selected from the group consisting of ethanol, methanol, acetone, dichloroethane, chloroform, and combinations thereof. In the present embodiment, the organic solvent is ethanol. After being soaked by the organic solvent, the carbon nanotube film structure can firmly adhere to the surface of the substrate due, in part at least, to the surface tension created by the organic solvent. The specific surface area is decreased, while the high mechanical strength and toughness thereof are still maintained.

A low-work-function layer can be further formed on the surface of the carbon nanotube film structure by a sputtering or vacuum evaporation method. The low-work-function layer is made of any material capable of inducing the emissions of electrons from the thermionic electron source at a low temperature, such as thorium oxide or barium oxide. Electrons in the low-work-function layer have a lower work function than that in the thermionic emitter, and can escape from the low-work-function layer at a lower temperature. Thus, the low-work-function layer can be used to induce emissions of electrons from the thermionic electron source at a lower temperature.

In step (c), the first electrode and the second electrode can be formed on the thermionic emitter by a method selected from a group consisting of a screen-printing method, an offset printing method, an electrostatic spraying method, an electrophoresis method, a lithography coating method, and a UV-curing method. The first electrode and the second electrode also can be formed by coating conductive glue on a surface of thermionic emitter away from the substrate to secure the first electrode and the second electrode thereon. In the present embodiment, the first electrode and the second electrode are formed by a screen-printing method.

Step (c), executed by the screen-printing method, further includes the following substeps: (c1) supplying conductive slurry; (a2) coating the conductive slurry on the surface of the thermionic emitter away from the substrate according to a predetermined pattern; and (a3) heat treating the substrate with the conductive slurry thereon, thereby forming the first electrode and the second electrode.

In step (c1), the conductive slurry includes conductive materials, adhesives, organic solvent and organic additives. The conductive material can be selected from a group consisting of gold, silver, copper and other conductive metal. The adhesive can be selected from a group consisting of inorganic binder, organic binder, and low melting point metals. The inorganic binder includes glass powder, silane and water glass. The organic binder includes fiber resins, acrylic resins, and ethylene resin. The adhesive can adhere conductive particles together, in addition to adhering conductive slurry on the surface of the substrate. A weight ratio of the conductive slurry and the adhesive approximately ranges from 0.1:10 to 10:1.

The organic additive includes tackifying agent, dispersants, plasticizers, or surface-active agent. The plasticizers can be selected from a group consisting of grass diethyl, low glass powder, and butyl ether. The organic solvent can be selected from a group consisting of ethanol, glycol, hydrocarbons, water, any other traditional solvents and mixtures thereof. Addition of the organic solvent and organic additives can adjust the properties of the conductive slurry, such as viscosity, liquid, dry speed, and other physical properties. As a result, it is conducive to coat the conductive slurry on the substrate. An amount of the organic solvents and additives can be adjusted according to the printing process. The conductive slurry can be placed into a stirring device to mix the ingredients thereof uniformly.

In the present embodiment, the conductive slurry includes a weight ratio of 75% silver, 21% adhesives, 3% low melting glass powder, and 2% ethanol. The adhesives are a solution of ethyl cellulose dispersed in terpineol. The conductive slurry is placed in a three-roll roller mill to uniformly distribute the ingredients thereof.

Step (c3) can be executed in an atmosphere or an environment with oxidized gas therein. A temperature of the heat treatment can be set according to organic ingredients of the conductive slurry. Generally, the temperature of the heat treatment is lower than 600° C. The heat treatment is used to form a good mechanical and electrical contact between the first electrode, the second electrode, and the thermionic emitter.

In the present embodiment, step (c3) can be executed by the following steps: firstly, heating the conductive slurry from 20° C. for 10 minutes, the temperature of the conductive slurry reaching up to 120° C, maintaining the temperature for 10 minutes to remove the terpineol and ethanol in the conductive slurry; secondly, heating the conductive slurry for 30 minutes, the temperature of the conductive slurry reaching up to 350° C., maintaining the temperature for 30 minutes to remove the ethyl cellulose; thirdly, heating the conductive slurry for 30 minutes, the temperature of the conductive slurry reaching up to 460-580° C., maintaining the temperature for 30 minutes to make the conductive slurry and the substrate combined closely; and finally cooling the conductive slurry, thereby separately forming a first electrode and a second electrode on the thermionic emitter.

Compared to conventional technologies, the thermionic electron source 10 provided by the present embodiments has the following advantages: firstly, since the thermionic emitter 18 adopts carbon nanotube film, and the carbon nanotubes in the carbon nanotube film are uniformly distributed, the thermionic electron source 10 adopting the thermionic emitter 18 can acquire uniform and stable thermal electron emissions states. Secondly, since the substrate 12 has a recess thereon, and at least part of the thermionic emitter 18 is suspended above the substrate the the thermionic emitter 18 will not transfer as much energy for heating to substrate 12. As a result, the thermionic electron source 10 will have an excellent thermionic emitting property. Thirdly, since the carbon nanotube film has a low resistance, the thermionic electron source 10 adopting the carbon nanotube film can emit electrons at a low thermal power. Thus, the thermionic electron source 10 can be used for high current density and high brightness of the flat panel display, logic circuits, and other fields.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A thermionic electron source comprising:

a substrate having a surface and a recess defined within the substrate, the recess extending inwardly from the surface of the substrate, the recess defining a recess bottom;

two electrodes formed on the substrate at opposite sides of the recess; and a thermionic emitter, the thermionic emitter being electrically connected at opposite sides thereof to the two electrodes , the thermionic emitter defining a first portion and a second portion, the first portion of the thermionic emitter extending between the two electrodes and across the recess in the substrate, the first portion having a first portion surface, the first portion surface directly facing the recess bottom.

2. The thermionic electron source as claimed in claim 1, wherein a depth of the recess is in a range about from 5 micrometers to about 1 millimeter.

3. The thermionic electron source as claimed in claim 1, wherein the thermionic emitter has a film structure or includes at least one wire.

4. The thermionic electron source as claimed in claim 1, wherein the thermionic emitter comprises a carbon nanotube film structure, and the carbon nanotube film structure comprises at least one carbon nanotube film, and the at least one carbon nanotube film comprises a plurality of carbon nanotubes oriented along a preferred orientation.

5. The thermionic electron source as claimed in claim 4, wherein the carbon nanotubes in the preferred orientation extends from the first electrode to the second electrode.

6. The thermionic electron source as claimed in claim 4, wherein the carbon nanotube film structure comprises at least two stacked carbon nanotube films, and adjacent carbon nanotube films are set at an angle between the aligned directions of the carbon nanotubes.

7. The thermionic electron source as claimed in claim 4, wherein each carbon nanotube film comprises a plurality of alike oriented carbon nanotube segments joined end-to-end by van der Waals attractive force therebetween.

8. The thermionic electron source as claimed in claim 7, wherein the carbon nanotube segment comprises a plurality of carbon nanotubes parallel with each other, and the adjacent carbon nanotubes are combined by van der Waals attractive force therebetween.

9. The thermionic electron source as claimed in claim 4, wherein a width of the carbon nanotube film in a range from about 0.01 centimeters to about 10 centimeters, and a thickness of the carbon nanotube film in a range from about 10 nanometers to about 100 micrometers.

10. The thermionic electron source as claimed in claim 1, further comprising a low-work-function layer located on a surface of the thermionic emitter opposite to the substrate.

11. The thermionic electron source as claimed in claim 10, wherein a material of the low-work-function layer is selected from the group consisting of barium oxide or thorium oxide.

12. The thermionic electron source as claimed in claim 1, wherein the two electrodes are fixed on the thermionic emitter by a conductive glue.

13. The thermionic electron source as claimed in claim 1, wherein the second portion of the thermionic emitter is in contact with the substrate.

14. The thermionic electron source as claimed in claim 1, wherein no article is interposed between the second portion of the thermionic emitter and the substrate.

15. The thermionic electron source as claimed in claim 14, wherein the thermionic emitter comprises a conductive material.

16. The thermionic electron source as claimed in claim 1, wherein the thermionic emitter is a free standing structure.

17. The thermionic electron source as claimed in claim 1, wherein the thermionic emitter is consisted of a carbon nanotube film structure.

18. The thermionic electron source as claimed in claim 1, wherein power taken by the second portion of the thermionic emitter is dissipated as heat only by radiation.

* * * * *